United States Patent [19]

McMakin

[11] Patent Number: 4,692,958

[45] Date of Patent: Sep. 15, 1987

[54] BUFFING PAD ASSEMBLY

[75] Inventor: Bruce L. McMakin, Hudson, Ohio

[73] Assignee: U.S. Chemical & Plastics, Inc., Canton, Ohio

[21] Appl. No.: 817,076

[22] Filed: Jan. 8, 1986

[51] Int. Cl.[4] ..... B24D 13/14

[52] U.S. Cl. ..... 15/230.12; 15/230; 15/230.17; 51/358; 51/376

[58] Field of Search ..... 15/98, 230, 230.12, 15/230.14, 230.16, 230.17, 230.18, 230.19; 51/358, 376

[56] References Cited

U.S. PATENT DOCUMENTS

| | | | |
|---|---|---|---|
| 3,007,189 | 11/1961 | Crane | 15/230 |
| 3,007,289 | 11/1961 | Kent et al. | 51/195 |
| 3,086,821 | 4/1963 | Kent et al. | 300/21 |
| 3,346,904 | 10/1967 | Armstrong | 15/230.17 |
| 3,522,681 | 8/1970 | Lampert | 51/358 |
| 3,990,124 | 11/1976 | McKay, Jr. et al. | 15/230.12 |
| 4,263,755 | 4/1981 | Globus | 51/358 |

FOREIGN PATENT DOCUMENTS

| | | | |
|---|---|---|---|
| 806890 | 2/1969 | Canada | 51/358 |

OTHER PUBLICATIONS

Brochure by Swiss International Abrasives, Ltd. of Switzerland.
Brochure by Redline Engineering Inc. in California.
Brochure by Tex Abrasives of Colchester, England.

*Primary Examiner*—Edward L. Roberts
*Attorney, Agent, or Firm*—Renner, Kenner, Greive, Bobak & Taylor

[57] ABSTRACT

A novel buffing pad 10 for use with a backing pad 40 adapted to be driven by a power tool 48. The pad 10 comprises a fabric pile 14 for application against a work piece 50, a backing side 15 carrying the fabric pile 14, loop means 21 carried centrally of the pad and against the backing side 15 and, cover means 21 partially affixed to the backing side 15 and enveloping the periphery of the loop means 22. A buffing pad assembly 12 utilizing the novel buffing pad 10 includes a plurality of backing structures 40 of progressively reduced diameters, each structure having hook means 43 from a hook and loop type fastener provided over the face of each structure and means for mounting 45 the structure on a power tool 48. A method for the manufacture of the novel buffing pad is also provided.

23 Claims, 12 Drawing Figures

BUFFING PAD ASSEMBLY

TECHNICAL FIELD

In general, this invention pertains to buffing pad assemblies that are used with power tools. Such pads are utilized for compounding, buffing, polishing and waxing operations for which different types of pads have been developed. In use, a backing plate is driven by the machine and the buffing pad is affixed either with a mounting nut or in the case of a bonnet, it is tied to the backing plate with a drawstring.

The present invention provides an alternative and novel means by which a replaceable buffing pad can be affixed to the backing plate. The overall structure of the assembly also provides a design which protects the surface being polished from the rotating edge of the backing plate. A method for the manufacture of the novel buffing pad is also set forth.

BACKGROUND ART

U.S. Pat. No. 3,990,124 describes a buffing pad assembly, adapted for drive by a power tool, which includes first and second buffing surfaces formed by joining together two pads in a back-to-back configuration. The pads are joined at their periphery, beyond the diameter of the backing pad, in order to protect the work surface treated from the rotating edge. Also, being double sided, the pad can be inverted to provide a clean fabric material or a different material altogether.

Other designs for protecting the work surface are set forth in U.S. Pat. Nos. 3,007,189 and 3,007,289. The former describes a cushioned pad, employing a layer of foam rubber between the backing plate and the buffing pad which extends over the edge of the backing plate. The latter is directed toward a dished buffing pad, the rear backing fabric of which is turned up during manufacture to form a curved peripheral edge. The backing plate member fits within this curved edge and is thereby prohibited from contacting the surface being polished.

Although the foregoing buffing pads are designed to protect the edges and at least one describes a reversible assembly, none has provided a means for more rapidly changing the pad. With such pads and existing comparable assemblies, it is necessary to remove a locking nut that fastens the pad to the tool, insert the nut through a new pad, affix the same to the backing plate and tighten. For the experienced operator, this total procedure can take one minute which is long enough that he may elect to continue using the same pad rather than change it as necessary, particularly in assembly line operations.

At least two companies, Swiss International Abrasives, Ltd. of Switzerland and Redline Engineering, Inc. in California offer backing discs that contain a hook and loop system such as Velcro or the like for use with machine sanding and grinding discs. However, to date, neither has employed such a system with buffing pads. At least one British company, Tex Abrasives of Colchester, England does offer a buffing pad that can be affixed to a Velcro backed backing pad. However, the pad is fully engaged by the hooks and lacks any structural strength of its own, which create use problems that have been obviated by the present invention.

DISCLOSURE OF THE INVENTION

It is therefore an object of the present invention to provide a buffing pad that can be quickly released from the backing structure.

It is another object of the present invention to provide a buffing pad assembly that protects the buffed or polished surfaces from damage by peripheral edges.

It is yet another object of the present invention to provide a buffing pad assembly having a plurality of backing structures whereby the operator can apply varying degrees of flexibility and areas of pressure to the work piece.

It is still another object of the present invention to provide a buffing pad assembly that can be utilized to apply rubbing compound, waxes, polishes and the like to painted surfaces.

It is yet another object to provide a method for fabricating a buffing pad that is quickly releasable from a backing plate.

These and other objects of the present invention together with the advantages thereof over the prior art forms, which will become apparent from the following specification are accomplished by means hereinafter described and claimed.

In general, a buffing pad for use with a backing plate adapted to be driven by a power tool includes a fabric pile for application against a work piece, a backing side carrying the fabric pile, loop means carried centrally of the pad and against the backing side and, cover means partially affixed to the backing side and enveloping the periphery of the loop means.

A buffing pad assembly for use with a power driven tool is also provided and it includes a plurality of backing structures of progressively reduced diameters and pad means. Each backing structure comprises hook means from a hook and loop type fastener provided over the face of each structure and means for mounting the structure on the tool. Each pad means comprises a fabric pile for application against a work piece, a backing side carrying the fabric pile, loop means from a hook and loop type fastener carried centrally of the pad and against the backing side and, cover means partially affixed to the backing side and enveloping the periphery of the loop means.

Lastly, a method for fabricating a buffing pad adapted for quick release from a backing plate driven by a tool is provided comprising the steps of affixing a fabric pile to the front side of a backing material, selecting a cover means having an open portion and a loop plate from a hook and loop type fastener, joining the loop plate and cover means together and, applying the cover means to the rear side of the backing material.

BRIEF DESCRIPTION OF THE DRAWINGS

FIGS. 4A, 4B–7A, 7B depict four variations of the buffing pad assembly of the present invention in use against a work piece.

PREFERRED EMBODIMENT FOR CARRYING OUT THE INVENTION

Buffing pads that can be employed for practice of the present invention include all those of known type having various fabrics such as natural wool strands, lambswool, synthetic fibers and the like as well as cloth materials such as terry cloth and the like. While these are commonly identified as buffing pads it is understood that some, the coarser ones, are more suited for applying rubbing compound while others being softer will perform better for polishing and waxing operations. For purposes of the following description, the buff material has been termed the fabric pile it being understood that this is intended not to single out a particular type of fiber, fabric, cloth or other material to the exclusion of any and all other types. Moreover, the chosen fabric pile can be affixed in any suitable manner such as weaving, stitching, adhesives or other.

In similar fashion, existing buffing pads are commonly manufactured with a hole in the center which allows the pad to be mounted and pre-spun to cast off the loose fibers left over from the stitching or related process. Although the hole can also be employed for mounting the pad on a backing structure in existing designs, it will be seen that it is not so employed for practice of the present invention and, therefore, the presence or absence of the hole does not hinder use of the buffing pad.

Figure 1:
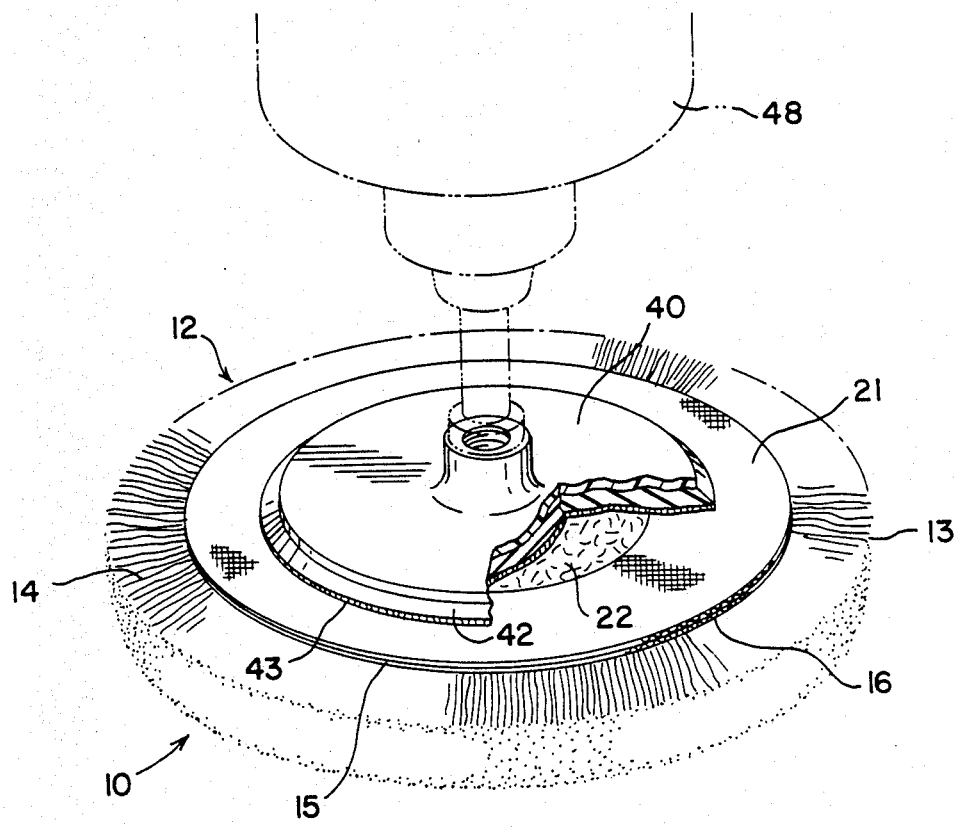
FIG. 1 is a perspective view of the buffing pad assembly of the present invention, partially in section.
Figure 2:
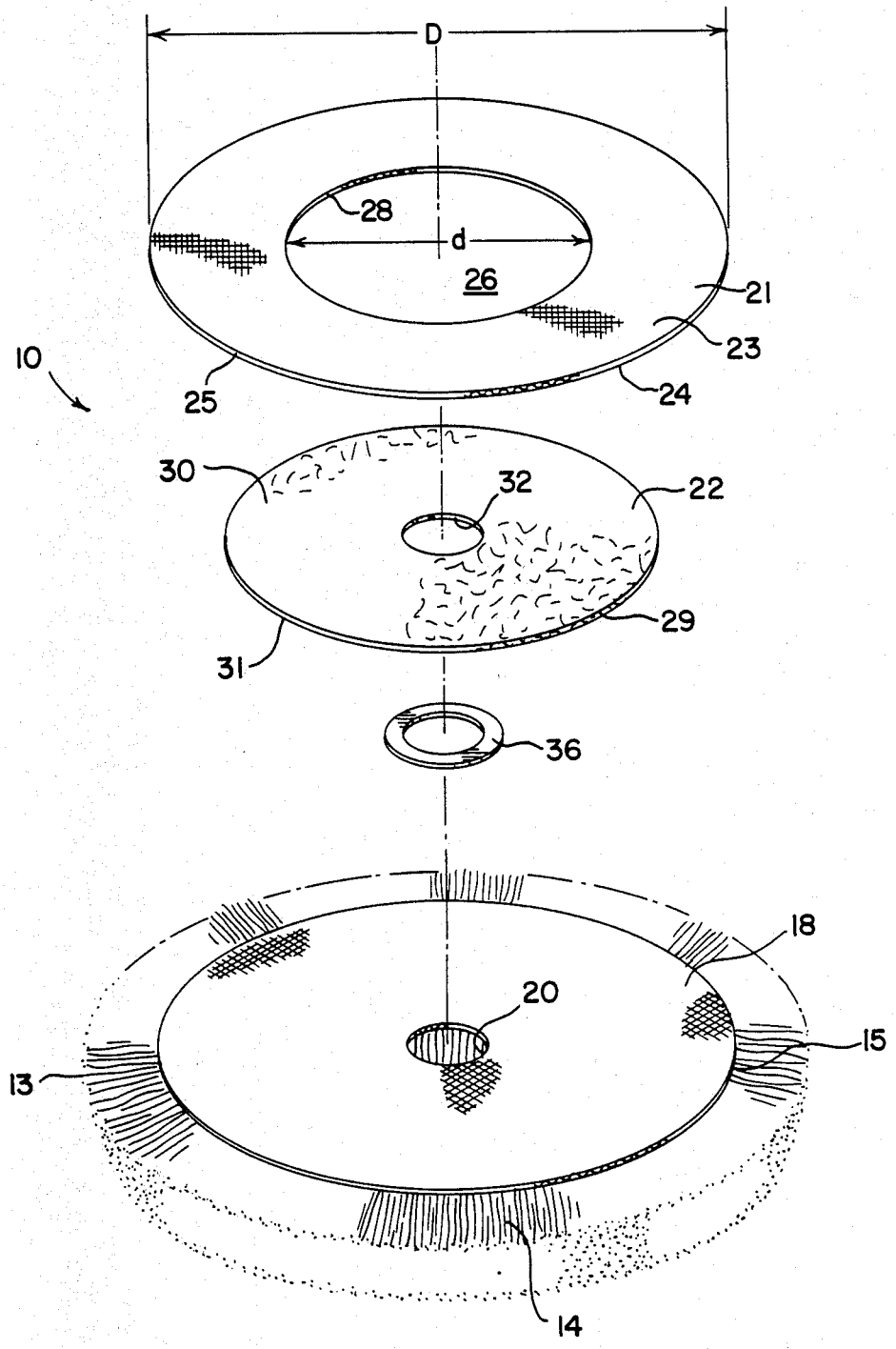
FIG. 2 is an exploded perspective of the buffing pad of the present invention.

With reference now to the drawings and particularly FIGS. 1 and 2, the novel buffing pad, referred to generally by the numeral

10, and buffing pad assembly, referred to generally by the numeral 12, shall be described. The buffing pad 10 includes a pad 13 having a working side that comprises the fabric pile 14, natural or synthetic as discussed hereinabove, and a backing side 15 that comprises cotton duck or comparable material, has a front and rear face, 16 and 18 respectively, and carries the working fabric. A central aperture 20 passes through the fabric and backing sides and is the means by which the pad 13 can be held and pre-spun as discussed hereinabove. Inasmuch as the aperture is not utilized in conjunction with mounting and driving the pad 13 with a power tool, an aperture need not be provided.

Additional elements of the buffing pad 10 include an annulus 21 and a loop plate 22. The annulus 21 has upper and lower surfaces 23 and 24, respectively, and outer edge 25 and a central cut-out portion 26 bounded by the edge 28. It is preferably a thick material and is the material used for the backing 15 such as cotton duck or the like. The outer diameter D of the annulus is equal to that of the backing side 15 in the finished product. During assembly, both are slightly larger and after being joined together as will be discussed hereinbelow, they are trimmed back to a finished diameter D. The inner diameter d of the annulus can be from about 25 to 80 percent of the diameter D and is preferably about 55 percent thereof.

The loop plate 22 is one-half of a hook and loop type fastener such as Velcro although other products can be substituted for the hook or loop component. The diameter of the plate 22 is greater than d and preferably less than D so that the outer edge 29 thereof falls somewhere on the annulus 21. The loop plate 22 has an upper surface 30 which is the loop side and a lower surface 31 as well as a central aperture 32 which is co-axial with the aperture 20 in pad 13.

The annulus and loop plate 22 are preferably affixed together with a suitable adhesive layer 35 (FIG. 3) that is applied to the lower surface 24 of ring 21 or the upper surface 30 of plate 22 or both. Because the upper surface 30 is the loop side, the loops are presented in the cut-out portion 26 of ring 21. A small fiber washer 36 is also adhesively affixed to the lower surface 31 of plate 22 as well as rear face 18 the purpose of which is primarily to reinforce the area around the apertures 20 and 32 for the subsequent spinning operation.

As the next step of the manufacture, the annulus 21 carrying the plate 22 and washer 36 is affixed to the backing side 15 of pad 13 with adhesive applied to either of the mating surfaces. The adhesive employed throughout all stages of the assembly is one that should be resistant not only to petroleum solvents that may be present in the liquids that are applied but also to the action of heat and water inasmuch as the pad is reusable and will therefore be subjected to washing. As a further consideration, the adhesive should be flexible inasmuch as the overall flexibility of the buffing pad 10 should not be diminished. Generally, hot melt adhesives are readily suitable although practice of the present invention need not be limited thereto.

The pad is then placed in a press to insure the development of maximum adhesion, the edges are trimmed from backing element 15 and annulus 21 as necessary and the pad is spun to release loose fibers. As completely assembled, the buffing pad 10 has a central loop portion lying beneath the annulus 21 and the latter acts as a cover enveloping the edge 29 and the outer area of the loop plate 22. It is important to the design and operation of the overall assembly 12, that the loop plate be recessed below the annulus 21 and that its edge 29 not be exposed. In this manner, release of the loop plate 21 and in turn the buffing pad 10 from the hook surface that is provided is carefully balanced, requiring enough force that the pad is not inadvertently released along horizontal, vertical and angular axes under the forces of rotation and work but not so much that the loop plate 22 can be torn free from the pad 10.

Figure 3:
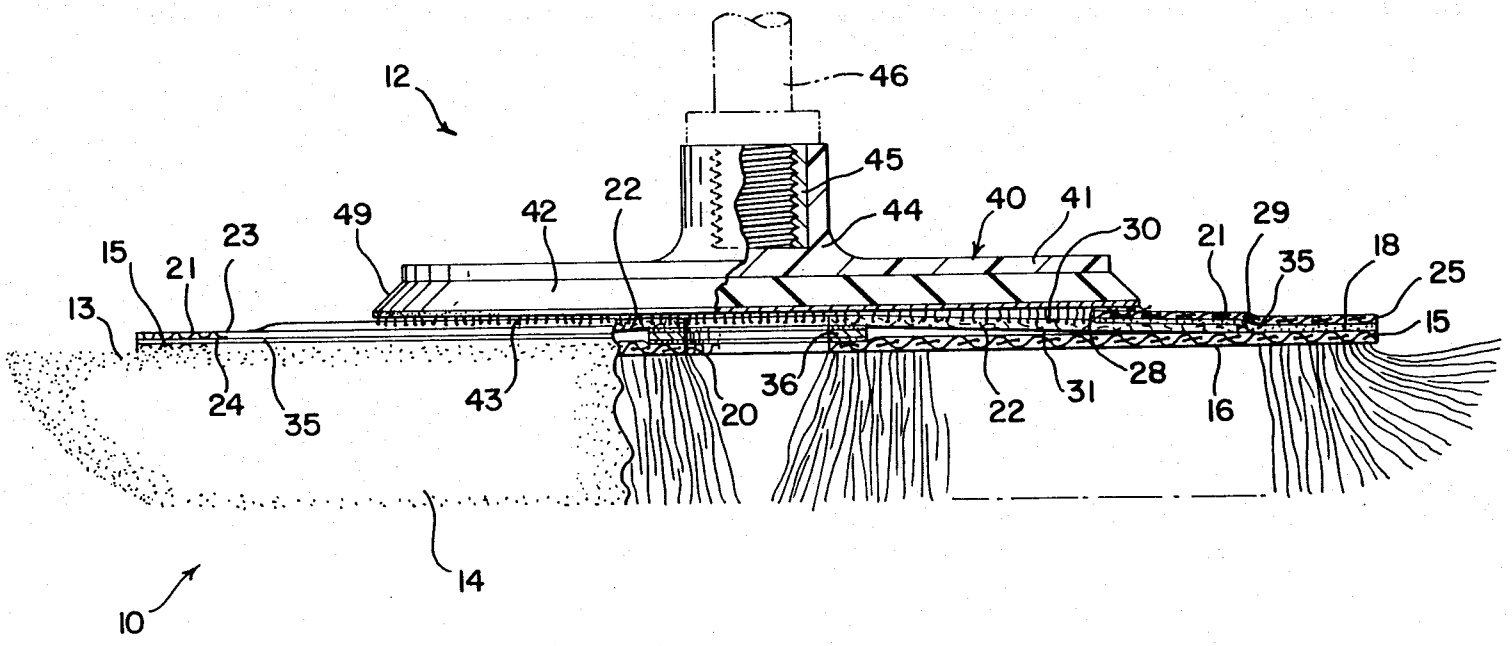
FIG. 3 is a side elevation, partially in section, of the buffing pad assembly of the present invention.

With reference next to FIG. 3 the backing plate 40 shall be described. The plate 40 comprises a hard flexible base 41 to which is affixed a cushion layer 42 of foam rubber or comparable material and a hook plate layer 43 to mate with the loop plate 22. The hook plate 43 is understandably one-half of a hook and loop type fastener such as Velcro. Velcro is a registered trademark of Velcro, Inc. for hook and loop type fasteners. Although any of the various hook configurations known can be employed, best results have been obtained during preliminary testing with a mushroom head hook plate 43 mating with a synthetic fabric loop plate 22. The mushroom head type of fasteners come in varying sizes according to shaft length and size of head. A more aggressive or firm grip between the plates 22 and 43 occurs as the shaft length increases as well as when the size and number of heads increases.

The base 41 carries a boss 44 on the back side which is provided with an internally threaded metal insert 45 for receipt of a drive spindle 46 from a power tool 48. Alternatively, a shaft (not shown) can be carried in lieu of the insert 45 for receipt by the chuck or other gripping mechanism of the tool 48. The cushion layer 42 is preferably cut with an outwardly extending edge 49 bevelled at 45° so that the greatest diameter of the backing plate 40 is almost equal to the diameter D of annulus 21 (FIGS. 4A, 4B) and is preferably slightly less in order to protect the work surface from the edge 49.

To use the assembly 12, the plate 40 is mounted on the tool 48 and then, by merely tapping the full face of the pad 10 the hook and loop fasteners engage and the pad is affixed. Because the hook plate 43 partially engages the annulus 21, a coupling of minimal strength is formed which becomes greater in the area of the loop plate 22 as depicted in FIG. 3. In this manner, upon removal of the pad 10 from the backing plate 40, there is no strong pull at the edge 49 of hook plate 43 as would tend to tear it away from the cushion 42. Moreover, the annulus tends to cover and protect the additional hooks that do not engage the loop plate 22 from debris.

Figure 4A:
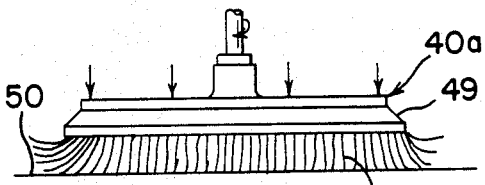
Figure 4B:
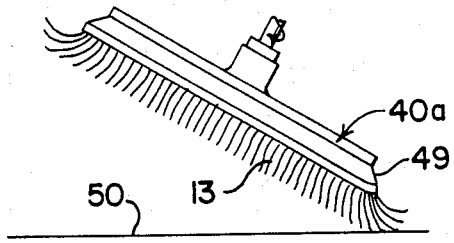

The buffing pad assembly 12 employs a plurality of backing plates 40 each having the structure previously described but with a progressively reduced diameter. With reference to FIGS. 4A, 4B–7A, 7B the purpose of each shall be discussed in conjunction with a plate 40 designated as 40*a*, 40*b*, 40*c* and 40*d* for clarity. The plate with the largest diameter, 40*a*, is depicted in FIGS. 4A, 4B in use over a work piece 50 such as the painted surface of an automobile body. Owing to the large area of the backing plate 40, when it is used on a large flat surface (FIG. 4A), all of the downward forces are distributed about the entire face of the pad 13 as indicated by the arrows. Where it is desirable to work a smaller area, such as an indentation or other contour, the edge of the pad may be employed (FIG. 4B). It is to be noted that the cushion edge 49 supports the pad so that edge burnishing is avoided.

Figure 5A:
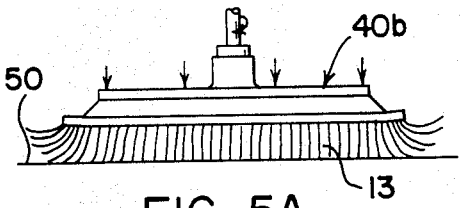
Figure 5B:
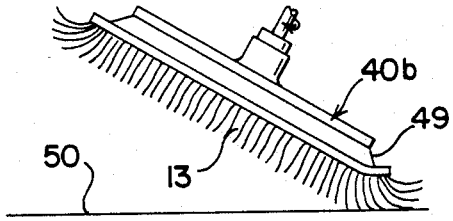
Figure 6A:
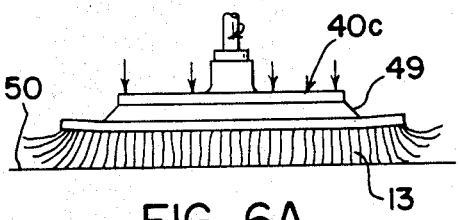
Figure 6B:
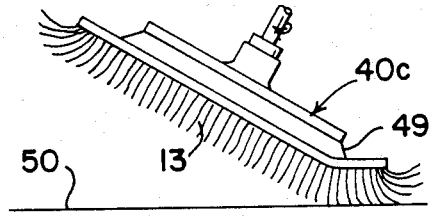
Figure 7A:
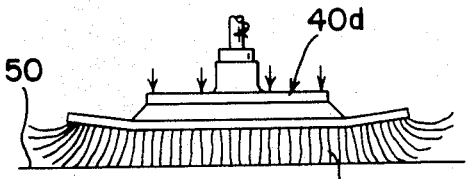
Figure 7B:
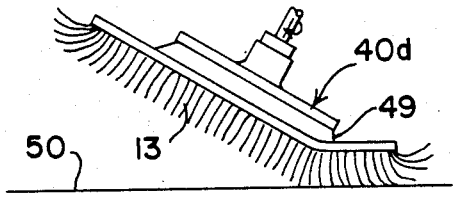

In FIGS. 5A, 5B, the next largest backing plate 40*b* is depicted in horizontal use, FIG. 5A and edge use, FIG. 5B. The same is true for FIGS. 6A, 6B and FIGS. 7A, 7B in conjunction with the backing plates 40*c* and 40*d*. In each instance, it will be noted that the area of primary force, depicted by the arrows, is reduced and the degree of flex is increased. Thus, the amount of flex is directly related to the size of backing plate; the largest plate provides the firmest buffing while the smallest provides the least. Unlike existing systems wherein different types of buffing pads are employed for various operations, one could apply compound with a buffing pad having a wool fiber fabric and using the largest backing plate 40*a*, and use the same type of pad for waxing operations by switching to a smaller backing plate, e.g., 40*c* or *d*.

Also, it is to be appreciated that the combination of the backing material 15, annulus 21, loop plate 22 and adhesive layers provides an increased structural support for the pad 10 which improves its performance with the various backing plates 40*a*–40*d*. The type of action and operation that can be performed with a given plate has been summarized in Table I for each of the four plates. Irrespective of the size of buffing pad 10, it is to be understood that the largest plate 40*a* should not exceed the diameter D of the annulus 21 while the smallest plate 40*d* will not be less than the diameter d of the annulus 21.

TABLE I

| Application of Various Backing Plates | | |
|---|---|---|
| Plate | Action | Operation |
| 40a | Super-Firm | Compounding |
| 40b | Firm | Compounding-Buffing |
| 40c | Flex | Polishing-Waxing |
| 40d | Super-Flex | Waxing |

Figure 8:
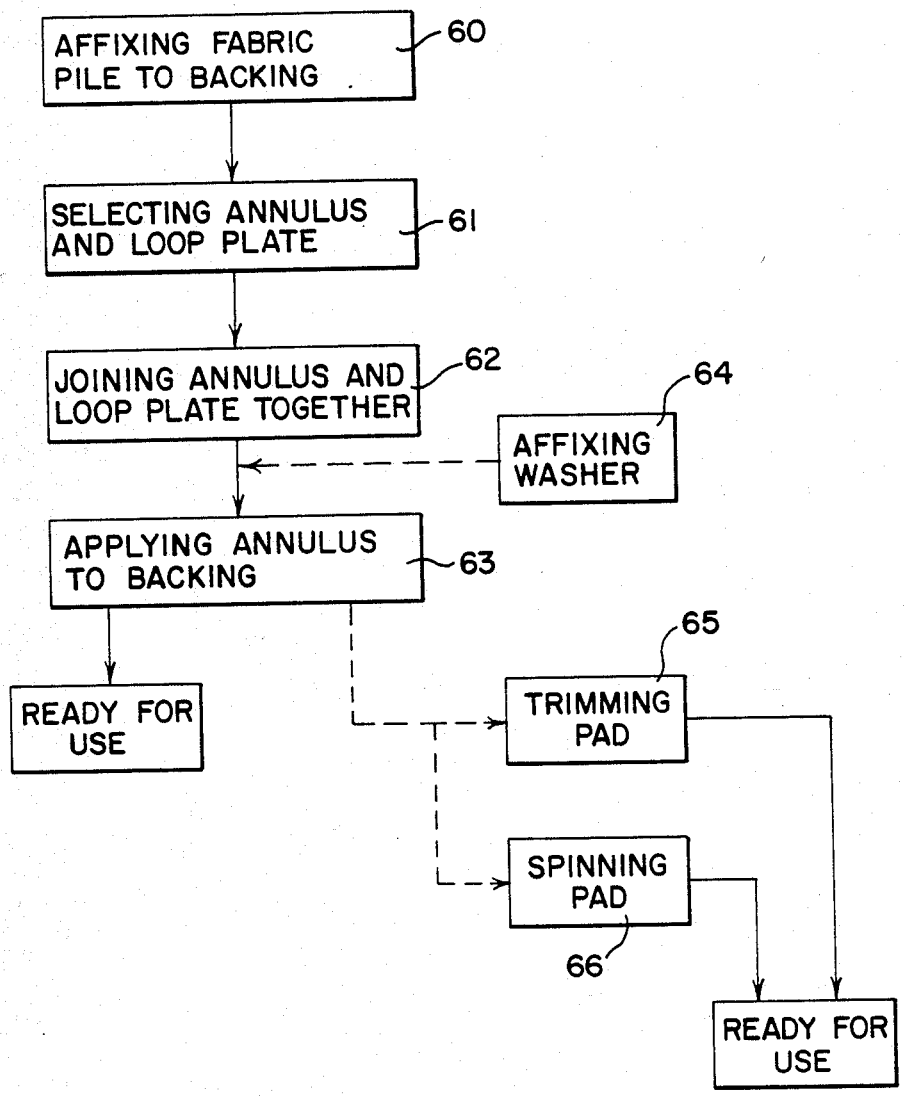
FIG. 8 is a flow chart that depicts the steps that are followed in the method for manufacturing a buffing pad of the present invention.

Lastly, a method has been developed by which the buffing pads 10 of the present invention can be manufactured. It will be explained in conjunction with the flow diagram set forth in FIG. 8.

As a first step, box 60, the fabric pile 14 is affixed to the front face 16 of backing pad 15 as by stitching, sewing or other suitable manner such as with adhesives. Next, an annulus 21 and loop plate are selected, box 61 and are subsequently joined together, box 62. Lastly, the annulus and loop plate are applied to the rear face 18 of backing 15, box 63. The steps of joining and applying are preferably with an adhesive which is applied only to the lower annular surface 24 and not the front or lower surface 31 of loop plate 22 so that the loop plate is permitted a limited degree of movement with respect to the pad 13. It will be appreciated that in conjunction with the adhesion steps, necessary ancillary operations such as the application of heat or pressure or both are implied. Moreover, while adhesives have been recited other means of joining including sewing, stitching, stapling and the like are not to be precluded.

As optional steps, box 64 has been included whereby the washer 36 is affixed to the loop plate lower surface 31 and the backing 15. Other steps include, alternatively, box 65 wherein the backing 15 and annulus 21 are trimmed to shape and/or box 66 wherein the finished pad is spun to remove excess fibers. Of course, where the fabric pile is cloth, e.g., terry cloth, and is sewn to the backing 15, the spinning step is not necessary. In any event the pad 10 can be ready for use after box 63, or 65 or 66.

Based upon the foregoing disclosure, it should now be apparent that the use of the assembly described herein will carry out the objects set forth hereinabove. It should also be apparent to those skilled in the art that the buffing pad and buffing pad assembly of the subject invention can be employed with a variety of fabric pile materials and in a variety of sizes as well as for other uses such as cleaning and buffing of halls, decks, floors and the like including surfaces of metal, wood, fiberglass, plastics and so forth, painted and unpainted. Moreover, a variety of adhesives can be selected as well as alternative operations for affixing the fabric pile to the backing. It is thus to be understood that any variations evident fall within the scope of the claimed invention; therefore, the selection of specific materials and component elements can be determined without departing from the spirit of the invention herein disclosed and described. Moreover, the scope of the invention shall include all modifications and variations that may fall within the scope of the attached claims.

I claim:

1. A buffing pad for use with a backing plate adapted to be driven by a power tool comprising:
   - a fabric pile for application against a work piece;
   - a backing side carrying said fabric pile;
   - loop means having a peripheral edge and carried centrally of said pad and against said backing side; and
   - cover means partially affixed to said backing side and enveloping said peripheral edge.

2. A buffing pad, as set forth in claim 1, wherein said cover means comprises an annulus having an outer diameter and an inner diameter, said inner diameter ranging from about 25 to about 80 percent of said outer diameter.

3. A buffing pad, as set forth in claim 2, wherein said annulus is cotton duck.

4. A buffing pad, as set forth in claim 2, wherein said loop means has a diameter less than said outer diameter and greater than said inner diameter and is affixed to said cover means.

5. A buffing pad, as set forth in claim 4, wherein the loops of said loop means are present in the center of said annulus and extend from said backing side.

6. A buffing pad, as set forth in claim 5, wherein said loop means comprises synthetic cloth and has a circular shape.

7. A buffing pad, as set forth in claim 1, wherein said fabric pile and said backing side carry a central aperture and said loop means is provided with a central hole coaxial with said aperture.

8. A buffing pad, as set forth in claim 7, further comprising a washer positioned about said hole of said loop means and affixed to the side opposite said loops.

9. A buffing pad, as set forth in claim 1, wherein said loop means is joined to said cover means with an adhesive and said cover means is joined to said backing side with an adhesive.

10. A buffing pad assembly for use with a power driven tool comprising:

a plurality of backing structures of progressively reduced diameters and pad means, each said structure having hook means from a hook and loop type fastener provided over the face of each said structure; and means for mounting said structure on said tool; and each said pad means having a fabric pile for application against a work piece;

a backing side carrying said fabric pile;

loop means from a hook and loop type fastener, having a peripheral edge and carried centrally of said pad and against said backing side; and cover means partially affixed to said backing side and enveloping said peripheral edge.

11. A buffing pad assembly, as set forth in claim 10, said backing structure further having cushion means interposed between the face of said structure and said hook means.

12. A buffing pad assembly, as set forth in claim 11, wherein said means for mounting includes a boss extending centrally from the rear face of said structure; and a threaded insert carried by said boss for receipt of a drive spindle.

13. A buffing pad assembly, as set forth in claim 10, wherein said cover means comprises an annulus having an outer diameter and an inner diameter, said inner diameter ranging from about 25 to about 80 percent of said outer diameter.

14. A buffing pad assembly, as set forth in claim 13, wherein said annulus is cotton duck.

15. A buffing pad assembly, as set forth in claim 13, wherein said loop means has a diameter less than said outer diameter and greater than said inner diameter and is affixed to said cover means.

16. A buffing pad assembly, as set forth in claim 15, wherein the loops of said loop means are present in the center of said annulus and extend from said backing side.

17. A buffing pad assembly, as set forth in claim 16, wherein said loop means comprises synthetic cloth and has a circular shape.

18. A buffing pad assembly, as set forth in claim 10, wherein said fabric pile and said backing side carry a central aperture and said loop means is provided with a central hole coaxial with said aperture.

19. A buffing pad assembly, as set forth in claim 18, further comprising a washer positioned about said hole of said loop means and affixed to the side opposite said loops.

20. A buffing pad assembly, as set forth in claim 10, wherein said loop means is joined to said cover means with an adhesive and said cover means is joined to said backing side with an adhesive.

21. A buffing pad assembly, as set forth in claim 10, wherein said cover means comprises an annulus having an outer diameter and an inner diameter, said inner diameter ranging from about 25 to about 80 percent of said outer diameter;

said loop means has a diameter less than said outer diameter and greater that said inner diameter and is affixed to said cover means; and the diameter of said hook means is greater than the inner diameter of said annulus.

22. A buffing pad assembly, as set forth in claim 21, wherein the diameter of said hook means present on at least one said backing structure is equal to the outer diameter of said annulus and said backing structure comprises a hard flexible material;

whereby the degree of flexibility of said pad means is equal to the flexibility of said backing structure.

23. A buffing pad assembly, as set forth in claim 22, wherein the diameter of said hook means on at least one said backing structure of reduced diameter is less than the outer diameter of said annulus and said pad means extends beyond the diameter of said backing structure;

whereby the degree of flexibility of said pad means is equal to the flexibility of said backing structure in the area covered thereby and is greater in the area extending beyond the diameter of said backing structure.

* * * * *